US007794246B2

(12) United States Patent
Cheng

(10) Patent No.: US 7,794,246 B2
(45) Date of Patent: Sep. 14, 2010

(54) ELECTRONIC STORAGE DEVICE HAVING MULTIPLE-DIRECTION ROTATION AND ALLOCATION ELECTRICAL CONNECTOR

(75) Inventor: Wei-Jen Cheng, Taipei (TW)

(73) Assignee: A-Data Technology (Suzhou) Co., Ltd., Suzhou, Jiangsu Province (CN)

( * ) Notice: Subject to any disclaimer, the term of this patent is extended or adjusted under 35 U.S.C. 154(b) by 0 days.

(21) Appl. No.: 12/533,445

(22) Filed: Jul. 31, 2009

(65) Prior Publication Data

US 2010/0151698 A1 Jun. 17, 2010

(30) Foreign Application Priority Data

Dec. 16, 2008 (CN) ..... 2008 1 0242824

(51) Int. Cl.
*H01R 13/44* (2006.01)

(52) U.S. Cl. ..... 439/138; 439/142

(58) Field of Classification Search ..... 439/142–144, 439/147, 135–138
See application file for complete search history.

(56) References Cited

U.S. PATENT DOCUMENTS 6,926,544 B2 8/2005 Lee
6,932,629 B2 8/2005 Ikenoue
7,473,112 B2 1/2009 Zhu et al.
7,544,073 B2 * 6/2009 Nguyen et al. ..... 439/135
2008/0276099 A1 * 11/2008 Nguyen et al. ..... 713/186

FOREIGN PATENT DOCUMENTS

CN 1331379 C 8/2005
CN 200941307 Y 8/2007

* cited by examiner

*Primary Examiner*—Javaid Nasri
(74) *Attorney, Agent, or Firm*—Cheng Ju Chiang

(57) ABSTRACT

An electronic storage device for connecting with a host system in accordance with the present invention includes a cover having a body section and a protection section bending from one end of the body section, and a main body having an electrical connector with an interface and defining a receiving space. The body section forms a positioning section of polygonal shape at the other end of the cover. The main body includes at least one cooperating portion disposed in the receiving space and having a flat cooperating surface. The body section of the cover covers the main body with the protection section covering the interface of the electrical connector to protect the interface. The positioning section is received in the receiving space of the main body and the main body is capable of rotating relative to the cover with the at least one cooperating portion rotating along the polygonal edge of the positioning section and being compressed by the positioning section to produce deformation.

19 Claims, 7 Drawing Sheets

ELECTRONIC STORAGE DEVICE HAVING MULTIPLE-DIRECTION ROTATION AND ALLOCATION ELECTRICAL CONNECTOR

CROSS-REFERENCE TO RELATED APPLICATIONS

This application claims priority to and the benefit of Chinese Patent Application No. 200810242824.4 filed in the State Intellectual Property Office of P.R.C. (SIPO) on Dec. 16, 2008, the entire contents of which are incorporated herein by reference.

BACKGROUND OF THE INVENTION

1. Field of the Invention

The present invention relates to an electronic storage device, more particularly to an electronic storage device having an electrical connector capable of rotating and allocating in multiple-direction.

2. Description of Related Art

In recent years, because of rapid development of Flash Memory technology, electronic data cannot only be stored in general hard disks, but also stored in solid memories conveniently. Compared with general hard disks, solid memory is more compact with less weight and shake resistance. Therefore, solid memories are widely used in different kinds of host systems, such as personal computers, notebooks, PDA (Personal Digital Assistance), and mobile phones et al. Different types of electronic storage devices adopting solid memory as storage media are widely used in daily life, such as Express Card, Flash Memory Card, USB Flash Drive, and MP3 Player.

However, no matter what type the electronic storage device belongs to, there must have an electrical connector, such as a USB connector, connects the host system and the electronic storage device. Electronic data can then be transferred from the host system to the electronic storage device. If the electrical connector of the electrical storage device is damaged, the electronic storage device cannot be used any longer. Hence, after the electrical connector is separated from the host system, the electrical connector should be protected to lengthen the service life thereof. CN1331379C, issued on Aug. 8, 2007, disclosed a Flash Drive apparatus which has a single body type rotary cover connecting with a main body which receives a USB connector inside by hinge means. The rotary cover forms protection to the USB connector to some extent. However, after long time use, the connection between the main body and the rotary cover is prone to become loose and cause relative rotation between the main body and the rotary cover, thus, it is not good for protection to the USB connector interface.

Further, as disclosed in CN200941307Y, issued on Aug. 29, 2008, a USB Flash drive apparatus utilized a U-shape metal ring which is capable of elastic deformation and can be served for rotating allocation. However, the rotating structure of the USB Flash drive apparatus is relatively complex which is not good for improving production efficiency.

Hence, it is desirable to design an improved structure to address problems mentioned above.

BRIEF SUMMARY OF THE INVENTION

Accordingly, an object of the present invention is to provide an electronic storage device having simple structure and capable of realizing rotation and allocation in multiple-direction.

In order to achieve the above-mentioned object, an electronic storage device for connecting with a host system in accordance with the present invention comprises a cover comprising a body section and a protection section bending from one end of the body section, and a main body comprising an electrical connector with an interface and defining a receiving space. The body section of the cover forms a positioning section of polygonal shape at the other end of the cover. The main body comprises at least one cooperating portion disposed in the receiving space and having a flat cooperating surface. The body section of the cover covers the main body with the protection section covering the interface of the electrical connector to protect the interface. The positioning section is received in the receiving space of the main body with the cooperating surface abutting against at least one polygonal edge of the positioning section. The main body is capable of rotating relative to the cover with the at least one cooperating portion rotating along the polygonal edge of the positioning section and being compressed by the positioning section to produce deformation.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
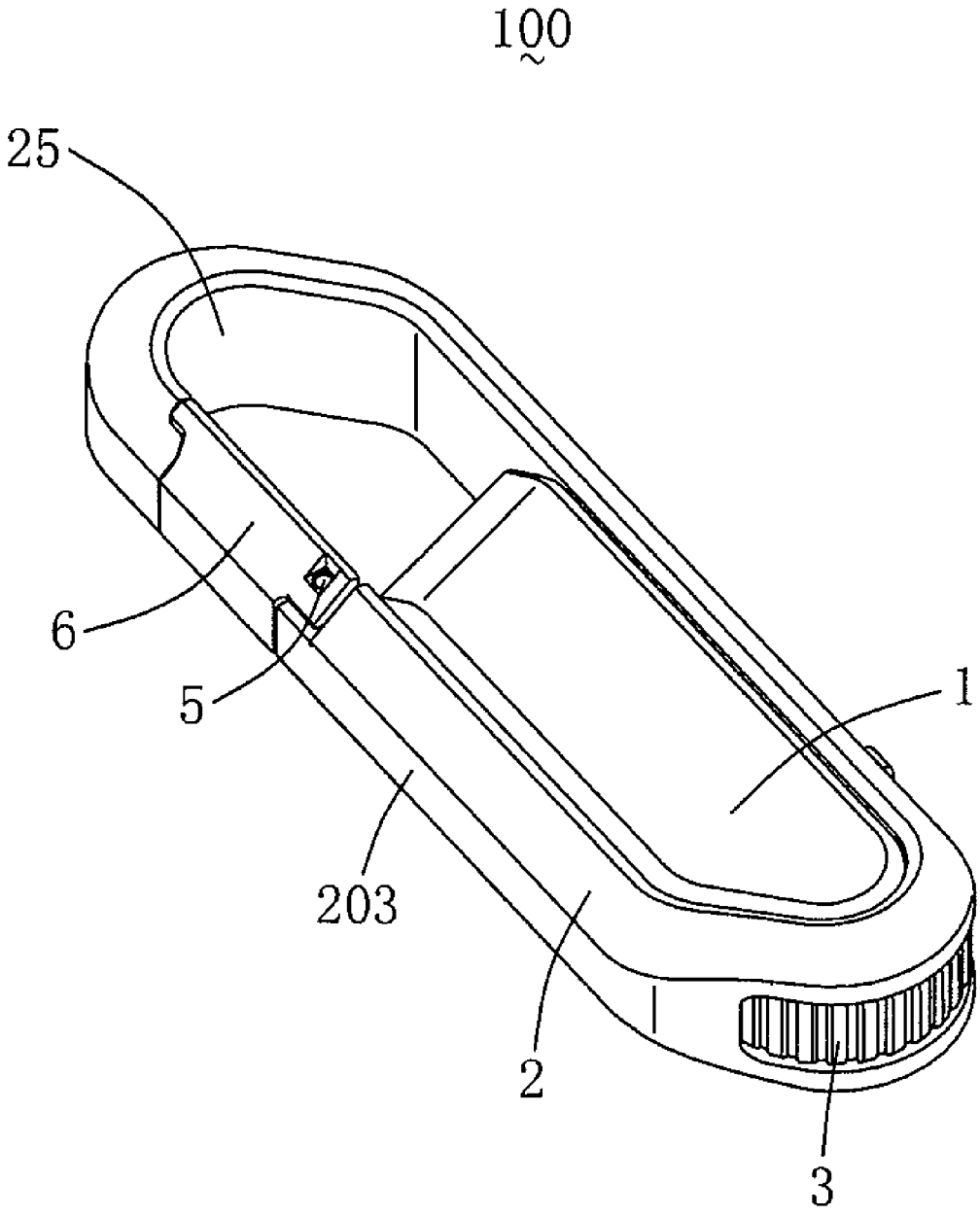
FIG. 1 is an assembled, perspective view of an electronic storage device in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-4, an electronic storage device 100 in accordance with the present invention comprises a frame 2, a top cover 1 assembled to the frame 2, a bottom cover 4 assembled to the frame 2 and cooperating with the top cover 1, and a main body 3 received in the frame 2 and capable of rotating and allocating relative to the frame 2 and top and bottom covers 1, 4 in multiple-direction.

Figure 2:
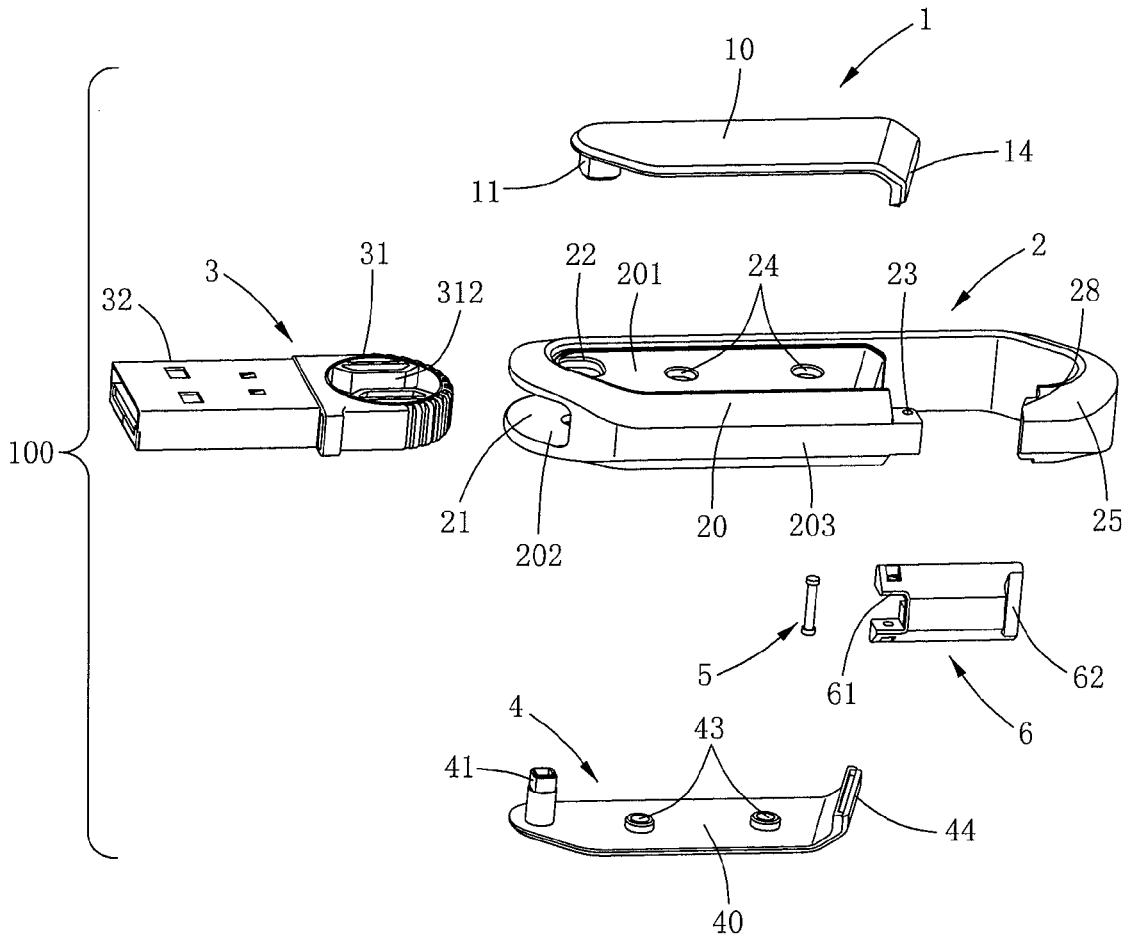
FIG. 2 is an exploded, perspective view of the electronic storage device.
Figure 3:
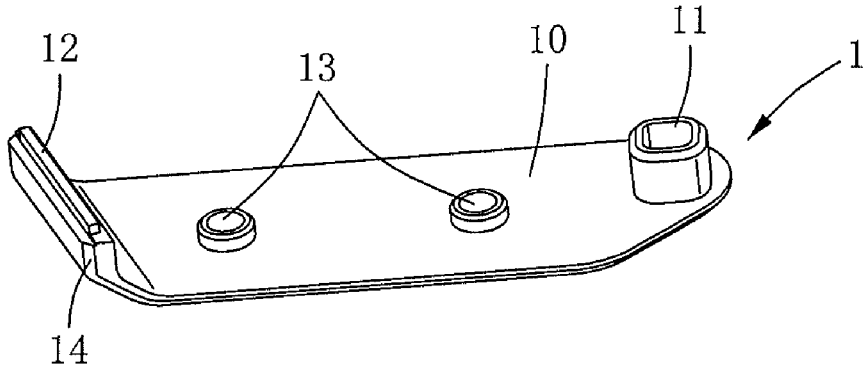
FIG. 3 is an enlarged view of a top cover of the electronic storage device viewed from a bottom aspect.

Referring to FIGS. 2-3, the top cover 1 is of L-shape and comprises a flat first body section 10 and a first protection section 14 bending downwardly from one end of the first body section 10. An elongate bar-shape first engaging section 12 protrudes downwardly from the first protection section 14. A pair of column-shape first mounting sections 13 protrudes downwardly from a bottom surface of the first body section 10 and a square-shape first positioning section 11 is formed at the other end of the first body section 10 and protrudes downwardly from the bottom surface. The first positioning section 11 is hollow and four corners are formed as arc-shape. However, in alternative embodiments, the shape of the first positioning section 11 is not only restricted as square-shape, also can be hexagon-shape or other polygon-shape according to actual needs. With different shapes, the first positioning section 11 is capable of realizing rotating in different angles.

Figure 5:
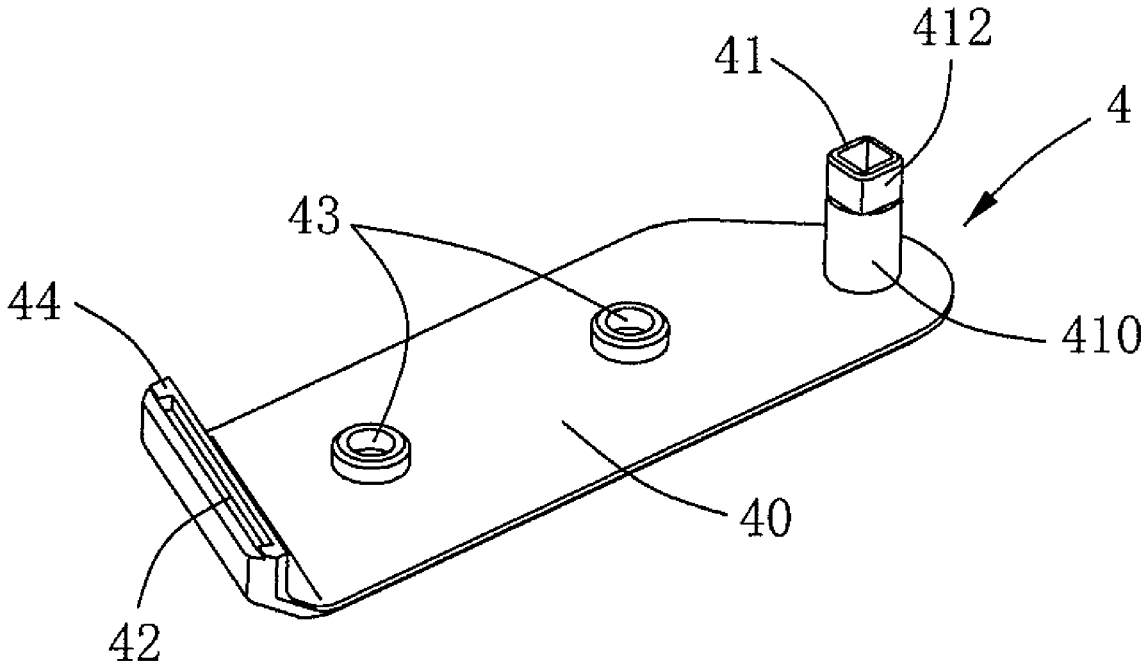
FIG. 5 is an enlarged view of a bottom cover of the electronic storage device viewed from a top aspect.

Referring to FIGS. 2 and 5, the bottom cover 4 is also of L-shape and has a similar structure to that of the top cover 1. The bottom cover 4 comprises a flat second body section 40 and a second protection section 44 bending upwardly from one end of the second body section 40. An elongate second engaging section 42 is recessed downwardly from the second protection section 44 and receives the first engaging section 12 for covering interface of the electrical connector 32 to form protection thereto. A pair of column-shape second mounting sections 43 protrudes upwardly from a top surface of the second body section 40 and a second positioning section 41 is formed at the other end of the second body section 40 and protrudes upwardly from the top surface. The second positioning section 41 forms a column-shape lower section 410 and a hollow square-shape upper section 412 corresponding to the first positioning section 11. The upper section 412 of the second positioning section 41 is also hollow and four corners thereof are formed as arc-shape. Further, the upper section 412 has an outer dimension slightly smaller than the inner diameter of the first positioning section 11, so the upper section 412 of the second positioning section 41 can be interferentially received within the first positioning section 11. Accordingly, in alternative embodiments, the shape of the upper section 412 of the second positioning section 41 is not only restricted as square-shape, also can be hexagon-shape or other polygon-shape according to actual needs. With different shapes, the first and second positioning sections 11, 41 are capable of realizing rotating in different angles.

Figure 4:
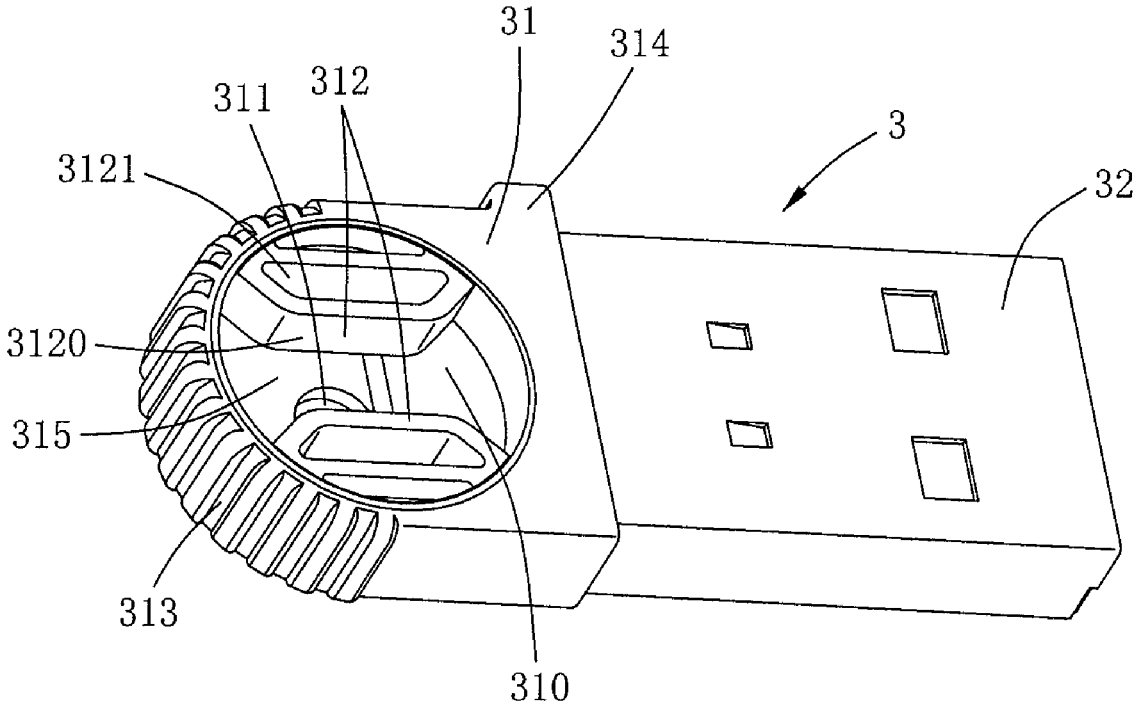
FIG. 4 is an enlarged view of a main body of the electronic storage device viewed from a top aspect.

Referring to FIGS. 2 and 4, the main body 3 comprises an electrical connector 32 (in the preferred embodiment, the electrical connector 32 is a USB type), and a pivoting portion 31 connecting with the electrical connector 32. The pivoting portion 31 defines a circular receiving space 310 in the center thereof. A semi-circular outer edge 313 is slotted with a plurality of slots for being actuated by hand conveniently. A pair of opposite cooperating portions 312 protrudes into the circular receiving space 310 from inner circumferential surface of the receiving space 310. Each cooperating portion 312 is provided with a flat cooperating surface 3120 and at least one slot 3121 therein for increasing elasticity thereof when cooperating with the top and bottom covers 1, 4. A circular engaging hole 311 with smaller size is defined in a bottom wall 315 of the pivoting portion 31 to communicate with the receiving space 310. A stop section 314 protrudes outwardly at one end of the pivoting portion 31 and adjacent to the electrical connector 32.

Referring to FIGS. 1 and 2, the frame 2 comprises a main portion 20 and an L-shape holding portion 25 extending from one side of the main portion 20. The main portion 20 comprises an upper wall 201, a lower wall 202 opposite to the upper wall 201, a lateral wall 203 connecting with the upper and lower walls 201, 202 and is partially cutoff to form a receiving cavity 21 together with the upper and lower walls 201, 202 for accommodating the main body 3. A pair of circular positioning holes 22 with different dimensions is respectively defined through the upper and lower walls 201, 202 at one end of the main portion 20 and communicate with the receiving cavity 21 for penetration of the first and second positioning sections 11, 41. The upper wall 201 and the lower wall 202 respectively defines a pair of engaging holes 24 for interferentially receiving the first and second mounting sections 13, 43 of the top and bottom covers 1, 4. So, after the main body 3 is assembled to the frame 2, the pivoting portion 31 is received in the receiving cavity 21 with the receiving space 310 aligning with the positioning holes 22. Then, the first and second covers 1, 4 are respectively assembled to the upper and lower walls 201, 202 of the frame 2 with the first and second mounting sections 13, 43 interferentially received in the engaging holes 24, the first positioning section 11 protruding through the positioning hole 22 with larger dimension and entering into the receiving space 310, while the lower section 410 of the second positioning section 41 protruding through the lower positioning hole 22 with smaller dimension and the engaging hole 311 of the main body 3 with the upper section 412 received in the first positioning section 1. Thus, a pair of parallel outer edges of the first positioning section 11 abuts against the flat cooperating surfaces 3120 of the cooperating portions 312. At the same time, the first and second protection sections 14, 44 combine with each other via the combination of the first and second engaging sections 12, 42 to protect the interface of the electrical connector 32.

In addition, the present invention also provides a shaft 5 assembled to the lateral wall 203, and a latch 6 pivotably assembled to the shaft 5 and between the lateral wall 203 and the holding portion 25 to be served as a mountaineering latch. One end of the lateral wall 203 defines a shaft-receiving hole 23 and the shaft 5 protrudes through one end 61 of the latch 6 then is received in the shaft-receiving hole 23. The latch 6 has the other end which is tapered as a tapered end 62 and is capable of rotating relative to the shaft 5 and the tapered end 62 can be stopped by a block section 28 formed at the free end of the holding portion 25. Thus, when the latch 6 is served as a mountaineering latch, the latch 6 can be blocked by the block section 28 for preventing separating from the frame 2 easily, thus, for safety security.

Figure 6A:
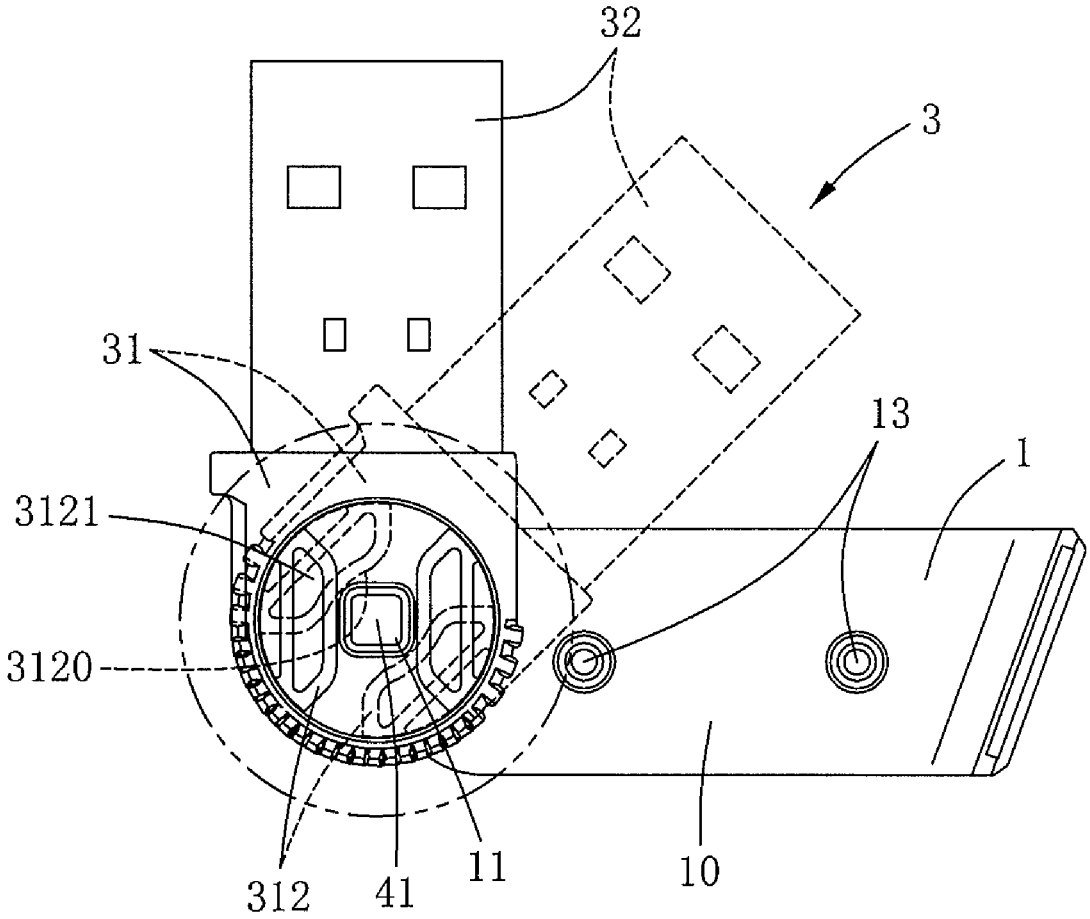
FIG. 6A is a sketch view illustrating how the main body rotates relative to other parts.
Figure 6B:
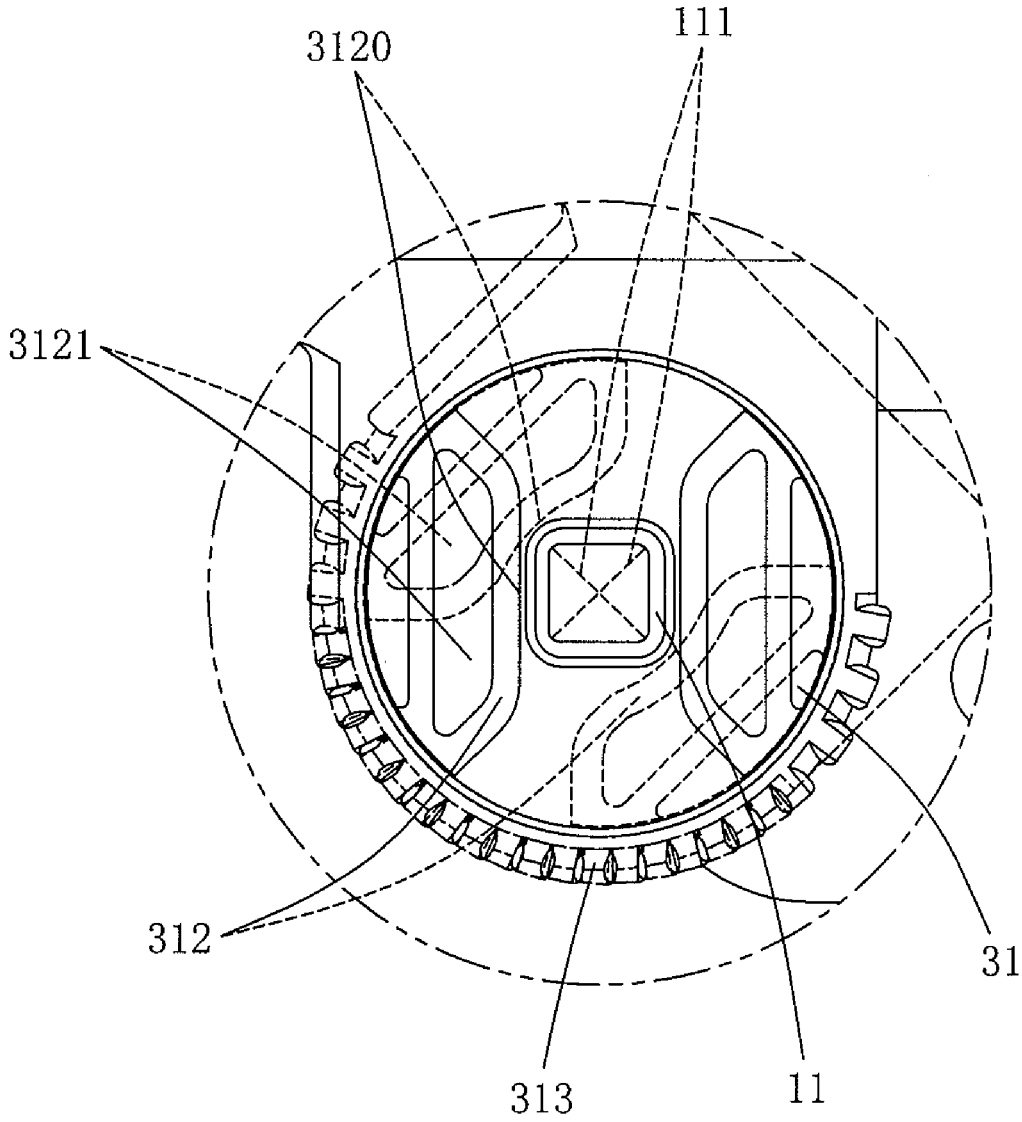
FIG. 6B is an enlarged view of a circled part in FIG. 6A.
Figure 7A:
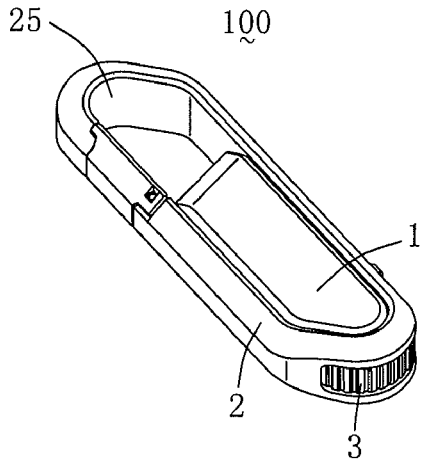
FIGS. 7A-7C are views illustrating different using states of the electronic storage device, and the electronic storage device respectively rotates 90 degrees and 180 degrees in FIGS. 7B and 7C.
Figure 7B:
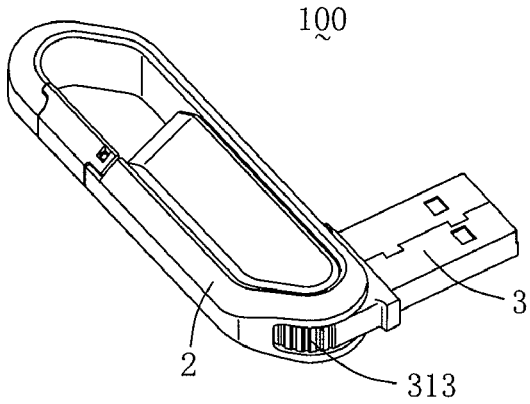
Figure 7C:
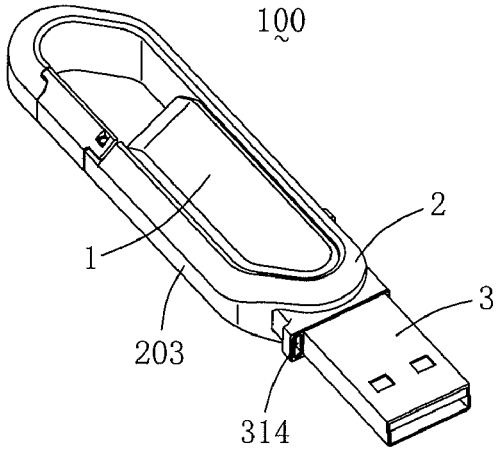

Please refer to FIGS. 1 and 7A, after assembly, the main body 3 is received in the receiving cavity 21 in a zero degree position. When operation, referring to FIGS. 7B and 6A-6B, an operator rotates the outer edge 313 along clockwise direction, the main body 3 is actuated to rotate along the same direction. Then, the cooperating surfaces 3120 of the rotating cooperating portions 312 are compressed or pressed by the two edges of the stationary first positioning section 11 and become curved to cause the slots 3121 to produce deformation, then after the rotating angle is more than 45 degrees or 135 degrees (that means the angle between the cooperating surface 3120 and one of a pair of diagonal lines 111 of the square-shape first positioning section 11), under the elastic restore force of the cooperating portions 312 and the outer operating force, the main body 3 can continue rotating automatically until the cooperating portions 312 abut against the other two edges of the first positioning section 11. Now, the main body 3 rotates 90 degrees relative to the frame 2 as illustrated in FIG. 7B. Then, the main body 3 can rotate another 90 degrees until the stop section 314 is stopped by the lateral wall 203 of the frame 2. Now, the main body 3 rotates 180 degrees relative to the frame 2 compared with the zero degree position illustrated in FIG. 7A. When the rotating angle is less than 45 degrees or 135 degrees, such as 30 degrees, the main body 3 will not rotate to the next position and return back to original position, thus, the main body 3 does not rotate relative to the frame 2.

In summary, when the shape of the first positioning section 11 is a regular polygon, then the operator needs to rotate the main body 3 more than an angle equal to 180 degrees divides the number of the edges of the regular polygon, and the main body 3 can rotate at an angle equal to 360 degrees divides the number of the edges of the regular polygon. For example, when the shape of the first positioning section 11 is a regular hexagon, then the main body 3 can rotate relative to the frame 2 at 60 degrees, 120 degrees and 180 degrees. Further, the main body 3 can only have one cooperating portion 312, which still can realize the function of being compressed by the first positioning section 11 and producing deformation. In addition, the top and bottom covers 1, 4 are made by metal and have handsome appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

I claim:

1. An electronic storage device adapted for connecting with a host system, comprising:

a cover comprising a body section and a protection section bending from one end of the body section, a positioning section of polygonal shape and integrally formed at the other end of the body section; and a main body comprising an electrical connector with an interface and defining a pivoting portion opposite to the interface of the electrical connector, and defining a receiving space, at least one cooperating portion disposed in the receiving space and integrally formed with the main body, and the at least one cooperating portion having a flat cooperating surface; and wherein the body section of the cover covers the main body with the protection section covering the interface of the electrical connector to protect the interface, the positioning section is received in the receiving space of the pivoting portion of the main body with the cooperating surface abutting against at least one outer polygonal edge of the positioning section, and the main body is capable of rotating relative to the cover with the at least one cooperating portion rotating along the outer polygonal edge of the positioning section and being compressed by the positioning section to produce elastic deformation; and wherein the main body is actuated to rotate more than an angle equal to 180 degrees divide the number of the edges of the polygonal positioning section so as to cause the main body to be capable of rotating and being retained at a location thereof relative to the cover with an angle equal to 360 degrees divide the number of the edges of the polygonal positioning section automatically.

2. The electronic storage device as claimed in claim 1, wherein the main body comprises a pair of cooperating portions each having a flat cooperating surface facing to each other and respectively abutting against a pair of outer edges of the polygonal positioning section.

3. The electronic storage device as claimed in claim 2, wherein each cooperating portion defines a slot therein for increasing elasticity and the slot produces elastic deformation when the cooperating portion is compressed by the positioning section.

4. The electronic storage device as claimed in claim 1, wherein the positioning section is of square shape, and wherein the main body is actuated to rotate more than 45 degrees along clockwise direction, the cooperating portion is capable of rotating 90 degrees automatically relative to the positioning section.

5. The electronic storage device as claimed in claim 1, wherein the cover is a top cover, the electronic storage device further comprises a bottom cover assembled to the top cover and the main body to protect the main body.

6. The electronic storage device as claimed in claim 5, wherein the bottom cover also comprises a body section and a protection section, and wherein the protection sections of the top cover and bottom cover cooperate with each other to cover the interface of the electrical connector for protection.

7. The electronic storage device as claimed in claim 6, wherein the bottom cover forms a second positioning section corresponding to the positioning section of the top cover, and wherein the second positioning section has the similar shape to that of the positioning section of the top cover and is received in the positioning section of the top cover.

8. The electronic storage device as claimed in claim 7, further comprising a frame defining a receiving cavity for receiving the main body, and wherein the top and bottom covers are assembled to the frame.

9. The electronic storage device as claimed in claim 8, wherein the frame comprises an upper wall and an opposite lower wall, and wherein the top and bottom covers are respectively assembled to the upper and lower walls.

10. The electronic storage device as claimed in claim 9, wherein the upper and lower walls of the frame respectively defines a pair of positioning holes with different diameters, and wherein the positioning sections of the top and bottom covers respectively protrude through the positioning holes and cooperate with the cooperating portions of the main body.

11. The electronic storage device as claimed in claim 9, wherein the frame comprises a lateral wall connecting with the upper and lower walls thereof, and wherein the lateral wall forms an L-shape holding portion for conveniently portable use.

12. The electronic storage device as claimed in claim 11, further comprising a latch assembled to the lateral wall to form a close loop together with the holding portion.

13. The electronic storage device as claimed in claim 12, further comprising a shaft assembled to one end of the lateral wall, and wherein the latch is assembled to the shaft and is capable of rotating relative to the shaft.

14. The electronic storage device as claimed in claim 13, wherein the lateral wall forms a block section at the other end thereof, and wherein the latch is capable of being blocked by the block section for preventing from being separated from the frame.

15. An electronic storage device adapted for connecting with a host system, comprising:

a frame defining a receiving cavity with opposite open ends;

a cover assembled to the frame to close one open end of the frame and at least one polygonal shape positioning section integrally formed with one of the cover or the frame and into the receiving cavity; and a main body rotatably received in the receiving cavity of the frame and comprising an electrical connector having an interface being protected by the cover adapted for electrically connecting with the host system, and defining a receiving space therein, at least one cooperating portion disposed in the receiving space and having a flat cooperating surface; and wherein the polygonal shape positioning section is received in the receiving space of the main body and at least one polygonal edge thereof abuts against the cooperating surface of the cooperating portion; the main body is actuated to rotate more than an angle equal to 180 degrees divides the number of the polygonal edges of the positioning section so as to cause the main body to be capable of reaching and being retained at a location thereof relative to the cover by rotating an angle equal to 360 degrees divides the number of the polygonal edges of the positioning section automatically with the cooperating surface abutting against a next polygonal edge of the positioning section.

16. The electronic storage device as claimed in claim 15, wherein the positioning section is of square shape, and wherein the main body is capable of rotating at 90 degrees and 180 degrees relative to the frame.

17. The electronic storage device as claimed in claim 15, wherein the cooperating portion defines a slot therein for increasing elasticity.

18. The electronic storage device as claimed in claim 17, wherein the slot produces deformation when the cooperating portion is compressed by the polygonal edge of the positioning section.

19. An electronic storage device adapted for connecting with a host system, comprising:

a cover comprising a body section and a protection section bending from one end of the body section, the body section forming a positioning section at the other end thereof and of polygonal shape; and a main body comprising an electrical connector with an interface and defining a receiving space, at least one cooperating portion disposed in the receiving space and having a flat cooperating surface; and wherein the body section of the cover covers the main body with the protection section covering the interface of the electrical connector to protect the interface, the positioning section is received in the receiving space of the main body with the cooperating surface abutting against at least one polygonal edge of the positioning section, and the main body is capable of rotating relative to the cover with the at least one cooperating portion rotating along the polygonal edge of the positioning section and being compressed by the positioning section to produce deformation; and wherein the cover is a top cover, the electronic storage device further comprises a bottom cover assembled to the top cover and the main body to protect the main body; and wherein the bottom cover also comprises a body section and a protection section, and wherein the protection sections of the top cover and bottom cover cooperate with each other to cover the interface of the electrical connector for protection; and wherein the bottom cover forms a second positioning section corresponding to the positioning section of the top cover, and wherein the second positioning section has the similar shape to that of the positioning section of the top cover and is received in the positioning section of the top cover; and wherein a frame defines a receiving cavity for receiving the main body, and wherein the top and bottom covers are assembled to the frame; and wherein the frame comprises an upper wall and an opposite lower wall, and wherein the top and bottom covers are respectively assembled to the upper and lower walls; and wherein the upper and lower walls of the frame respectively defines a pair of positioning holes with different diameters, and wherein the positioning sections of the top and bottom covers respectively protrude through the positioning holes and cooperate with the cooperating portions of the main body.

* * * * *